US008490364B2

(12) United States Patent
Spransy

(10) Patent No.: US 8,490,364 B2
(45) Date of Patent: Jul. 23, 2013

(54) WALL SYSTEM EMPLOYING BATTEN ASSEMBLIES SECURED TO STUDS WITHOUT USING SCREWS

(75) Inventor: Peter J. Spransy, Salt Lake City, UT (US)

(73) Assignee: DAW Technologies, Inc., Salt Lake City, UT (US)

( * ) Notice: Subject to any disclaimer, the term of this patent is extended or adjusted under 35 U.S.C. 154(b) by 309 days.

(21) Appl. No.: 11/672,477

(22) Filed: Feb. 7, 2007

(65) Prior Publication Data

US 2007/0193218 A1 Aug. 23, 2007

Related U.S. Application Data

(60) Provisional application No. 60/771,050, filed on Feb. 7, 2006.

(51) Int. Cl.
*E04B 2/78* (2006.01)

(52) U.S. Cl.
USPC ..... 52/772; 52/464; 52/468

(58) Field of Classification Search
USPC ..... 52/773, 772, 781.3, 781, 466, 468, 52/465, 464, 463, 461, 774
See application file for complete search history.

(56) References Cited

U.S. PATENT DOCUMENTS

| | | | | |
|---|---|---|---|---|
| 3,057,444 | A | 10/1962 | Walberg | |
| 3,513,606 | A | 5/1970 | Jones | |
| 3,566,561 | A | 3/1971 | Tozer | |
| 4,270,332 | A | 6/1981 | Montrouil | |
| 4,625,483 | A | 12/1986 | Zacky et al. | |
| 4,984,400 | A | 1/1991 | Bockmiller | |
| 5,307,600 | A | 5/1994 | Simon, Jr. et al. | |
| 5,414,967 | A | 5/1995 | Cates et al. | |
| 5,634,300 | A | 6/1997 | Huebner et al. | |
| 6,712,540 | B2 * | 3/2004 | Schmalzhofer et al. | 403/248 |
| 2003/0200704 | A1 * | 10/2003 | Cornell et al. | 52/36.1 |

* cited by examiner

*Primary Examiner* — Michael Safavi
(74) *Attorney, Agent, or Firm* — Madson IP, P.C.

(57) ABSTRACT

A batten system includes a stud, at least one removable flange and at least one closure strip. The at least one removable flange is secured to the stud by the closure strip without the use of a screw. The stud includes a neck opening with at least one receiving trough. The stud also includes a hammerhead-nut channel. The hammerhead-nut channel has a predetermined profile. In some embodiments, the screw-less batten system includes a hammerhead-nut.

20 Claims, 11 Drawing Sheets

WALL SYSTEM EMPLOYING BATTEN ASSEMBLIES SECURED TO STUDS WITHOUT USING SCREWS

RELATED APPLICATIONS

This application is related to and claims priority from U.S. Provisional Patent Application Ser. No. 60/771,050 filed Feb. 7, 2006, for a Screw-Less Batten System for Cleanroom Walls with Mechanism for Hanging Attachments, with inventor Peter J. Spransy which is incorporated herein by reference.

TECHNICAL FIELD

The present invention relates to batten systems. More specifically, the present invention relates to a screw-less batten systems.

BACKGROUND

Typically screws are required to attach wall battens. Several challenges may exist that are associated with screws being used to attach battens inside a cleanroom. For example, the cost of the wall, including installation, is always of great concern particularly in a competitive bid situation. By eliminating the screws used to attach the battens, then the screw holes on the battens, the labor to attach the screws and the screws themselves may also be eliminated thus reducing the final cost of the wall.

Cleanroom floor panels are typically perforated and/or grated to provide an airflow path for the constant recirculation of filtered air through the cleanroom, which is essentially what creates a "clean" room. In addition, installers are generally required to wear full cleanroom "bunny" suits with double-gloved hands during the installation process. This may greatly increase the likelihood that a screw or screws will be dropped having the potential of falling through the grated floor and falling as much as three stories below onto highly sensitive equipment.

Harmful particulates may be generated every time a screw is screwed into and out of an aluminum screw slot and every time a new hole is predrilled for a screw. Screw slots can typically only be used a limited number of times before the part using the screw slot needs to be replaced because the screw will no longer stay in the galled screw slot.

The manufacturing of semiconductors is highly sensitive. In addition, the life cycle of semiconductors is extremely volatile. When prices are good and the process is running well semiconductor manufacturers must "strike while the iron is hot." Semiconductor manufacturers typically do not tolerate lengthy interruptions or delays of their manufacturing process.

Cleanroom wall heights are currently 12'-0" to 16'-0" tall. This means that for every 4 linear feet of wall 18 to 22 screws are typically installed atop scaffolding. This type of installation is a lengthy process. A solution to this problem may be to provide a wall system that creates the least amount of disruption to their business. By eliminating the screws required to install the wall the install rates for the wall may be significantly improved.

Each time an installer enters the cleanroom they must go through an elaborate gowning process. If for any reason the installer must exit the cleanroom they must pass through the same elaborate gowning process in reverse. Tools, wall appurtenances, hardware, etc. must also pass through an elaborate wipe down process before entering the cleanroom. Therefore, it may be an advantage to reduce the number of parts and pieces required to install the wall. For example, if an installer is in full gown and in the cleanroom discovers that a new hole must be drilled, the installer may take up to half an hour to exit the cleanroom, remove the gown, drill the hole, wipe down the batten or stud, put the gown back on, and install the batten. A solution to this problem may be to eliminate the screws because eliminating the screws reduces the number of tools, wall appurtenances, and hardware required to install the wall.

Some cleanroom wall systems are progressive wall systems. Progressive wall systems are serially assembled and disassembled. For example, because the walls are assembled one after another, to remove a single wall panel, all intervening wall panels must also be removed.

Cleanroom walls generally should be smooth, so no ledges are present to collect particulate; cleanable so wipe down of the walls, which happens multiple times per day, removes any particulate present; and fast to erect, because any interruptions to the semiconductor manufacturing process may be devastating. Manufacturers typically want fast installation and modification times.

It may also be desirable to be able to hang shelving and other attachments on a wall system without having the drawbacks involved with systems using screws.

SUMMARY OF THE INVENTION

A screw-less batten system is described that includes a stud, at least one removable flange and at least one closure strip. The stud includes a neck opening with at least one receiving trough. The stud also includes a hammerhead-nut channel having a predetermined profile. In some embodiments, the stud includes a second neck opening with at least one receiving trough and a second hammerhead-nut channel having a predetermined profile.

In most embodiments, the screw-less batten system includes a hammerhead-nut. In some embodiments, the hammerhead-nut channel includes an internal wall and the hammerhead-nut is inserted through the neck opening and into the hammerhead-nut channel in the stud and engages the internal wall of the hammerhead-nut channel. In further embodiments, the at least one removable flange includes an engaging surface and the hammerhead-nut includes a flange engaging surface, the flange engaging surface of the hammerhead-nut engages the engaging surface of the at least one flange when the hammerhead-nut is inserted into the hammerhead-nut channel. In still further embodiments, the hammerhead-nut includes a stud engaging surface, and the stud engaging surface of the hammerhead-nut engages the internal wall of the hammerhead-nut channel.

In some embodiments, the at least one removable flange includes a back support surface and the hammerhead-nut includes a back support surface, at least a portion of the back support surface of the hammerhead-nut abuts at least a portion of the back support surface of the at least one removable flange. In further embodiments, the hammerhead-nut is inserted between two of the closure strips.

The at least one removable flange, in some embodiments, includes a locking member and an engaging surface and the at least one closure strip secures the engaging surface of the at least one removable flange such that the locking member of the removable flange is inserted into the corresponding at least one receiving trough. In further embodiments, the at least one receiving trough prevents substantial transverse motion of the corresponding at least one removable flange.

In some embodiments, the stud includes an integral flange. In further embodiments, the screw-less batten system includes a wall panel. In still further embodiments, the at least one removable flange prevents substantial transverse motion of the wall panel.

The screw-less batten system, in some embodiments, includes an attachment that is supported by the hammerhead-nut. In further embodiments, the hammerhead-nut prevents substantial transverse motion of the attachment. In still further embodiments, the hammerhead-nut prevents substantial vertical motion of the attachment.

Another embodiment of a screw-less batten system for cleanroom walls is described. The system includes at least one wall panel, a plurality of removable flanges, a stud, a plurality of closure strips, a hammerhead-nut and an attachment. The plurality of removable flanges includes an engaging surface, a back support surface and a locking member. The stud includes a neck opening. The neck opening includes a plurality of receiving troughs corresponding with the plurality of removable flanges. The plurality of receiving troughs are shaped to receive the locking members of the plurality of removable flanges. The slot includes a hammerhead-nut channel having a predetermined profile. The hammerhead-nut channel includes an internal wall. The plurality of closure strips secure the engaging surfaces of the plurality of removable flanges such that the locking members of the plurality of removable flanges are inserted into their corresponding plurality of receiving troughs to prevent substantial transverse motion of the corresponding plurality of removable flanges and the wall panel. The hammerhead-nut is inserted through the neck opening and into the hammerhead-nut channel in the stud between two closure strips. The hammerhead-nut includes a flange engaging surface that engages the engaging surface of two of the plurality of removable flanges. The hammerhead-nut also includes a stud engaging surface that engages the internal wall of the hammerhead-nut channel and a back support surface, wherein at least a portion of the back support surface of the hammerhead-nut abuts at least a portion of the back support surfaces of two removable flanges. The attachment is supported by the hammerhead-nut such that the hammerhead-nut prevents substantial transverse motion of the attachment.

A further embodiment of a screw-less batten system for cleanroom walls is described. The system includes at least one wall panel, a removable flange, a stud, a plurality of closure strips, a hammerhead-nut and an attachment. The removable flange includes an engaging surface, a back support surface and a locking member. The stud includes a neck opening with a receiving trough that prevents substantial transverse motion of the removable flange. The stud also includes an integral flange with an engaging surface and a back support surface. The stud further includes a hammerhead-nut channel with a predetermined profile. The hammerhead-nut channel has an internal wall. The plurality of closure strips secure the engaging surface of the removable flange and the engaging surface of the integral flange such that the locking member of the removable flange is inserted into the receiving trough and the removable flange and the integral flange prevent substantial transverse motion of the wall panel. The hammerhead-nut is inserted through the neck opening and into the hammerhead-nut channel in the stud between two closure strips. The hammerhead-nut includes a flange engaging surface that engages the engaging surface of the removable flange and the engaging surface of the internal flange. The hammerhead-nut also includes a stud engaging surface that engages the internal wall of the hammerhead-nut channel and a back support surface. At least a portion of the back support surface of the hammerhead-nut abuts at least a portion of the back support surface of the removable flange and the integral flange. The attachment is connected to the hammerhead-nut such that the hammerhead-nut prevents substantial transverse motion of the attachment.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Various embodiments of the invention are now described with reference to the Figures, where like reference numbers indicate identical or functionally similar elements. The embodiments of the present invention, as generally described and illustrated in the Figures herein, could be arranged and designed in a wide variety of different configurations. Thus, the following more detailed description of several exemplary embodiments of the present invention, as represented in the Figures, is not intended to limit the scope of the invention, as claimed, but is merely representative of the embodiments of the invention.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Depending upon the layout of the walls and process equipment, it may be common for the wall panel access to be limited to one side of the wall only. The screw-less battens may be removable from both sides of the wall for instances where access is restricted.

The screw-less batten may be designed primarily to eliminate the need for screws to attach the wall battens. Some embodiments use an extruded flange that is configured to hook into an extruded stud and then held in place by an extruded plastic closure piece. The strength of the flange may not be dependant upon the plastic closure; rather, its strength may come from the hook arrangement to the stud. The closure piece may prevent the flange from becoming disengaged from the stud.

The screw-less batten system may be economically superior over present wall systems because it generally requires fewer parts to assemble. Compared to present wall systems, the screw-less batten system may have an increased install rate because the installer typically does not have to use screws. Having a reduced number of parts, particularly small parts inside the cleanroom may provide an additional advantage over present wall systems because this may reduce the number of particulates that may be introduced into a room. Because the screw-less batten system may use fewer parts than present wall systems, the user may not have to store as many parts in inventory as required with present wall systems. Additionally, because the screw-less batten system may not use screws, the user may see a reduction of particle generation when installing or modifying this wall over present wall systems. The parts for a screw-less batten system may rarely need to be replaced versus wall parts having integral screw-slots that become "galled" over time. The wall panels in a screw-less batten system may be removed from either side of the wall whereas some wall systems only permit access from one side.

Figure 1:
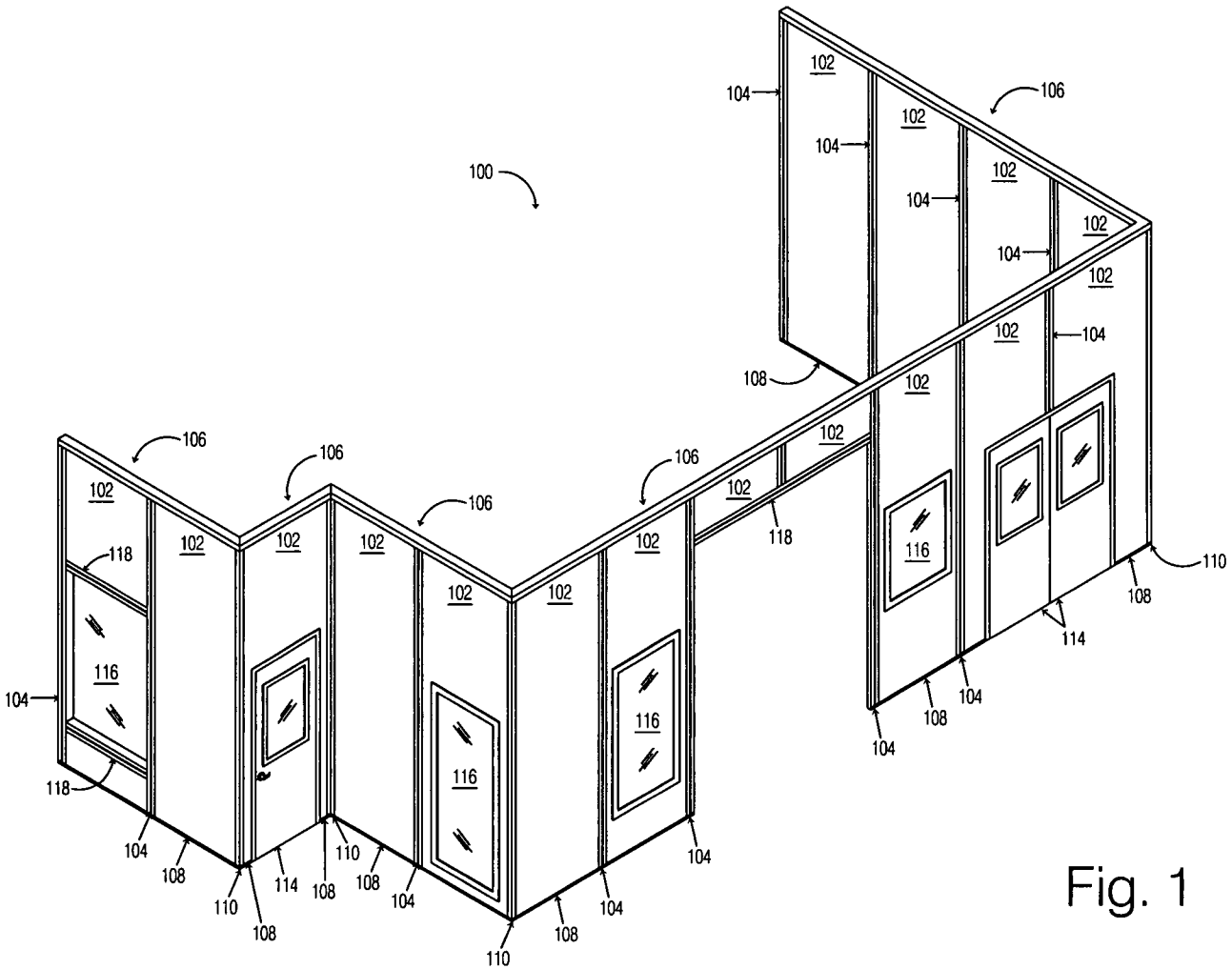
FIG. 1 is a perspective view of an embodiment of a partially assembled cleanroom.

FIG. 1 is a perspective view of an embodiment of a partially assembled cleanroom 100. The cleanroom may include multiple wall panels 102. In the present embodiment, the wall panels are 1.75 inches thick. The wall panels may be assembled using screw-less batten assemblies 104. In the present embodiment, the screw-less batten assemblies 104 are double sided. A double sided screw-less batten assembly may use battens or flanges on both sides of a wall panel 102. The wall panels 102 may be secured and/or supported by a floating head track 106 and a base track 108. In the present embodiment, inside and outside corners 110 may be used to secure the wall panels 102 where the wall panels 102 are not substantially parallel. In other embodiments, screw-less batten assemblies 104 may be used to secure the wall panels 102 where the wall panels 102 are not substantially parallel.

Doors 114 may be used in the cleanroom 100. The doors may include their own framing (not shown) or may be framed using screw-less batten assemblies 104. For example, screw-less batten assemblies 104 may be used to create a door opening. Some wall panels 102 may include glazed panels 116. Glazed panels 116 may come in varying sizes. In the present embodiment, the glazed panels 116 may be supported using horizontal framing 118. In other embodiments, the glazed panels 116 may be framed using screw-less batten assemblies 104.

Figure 2:
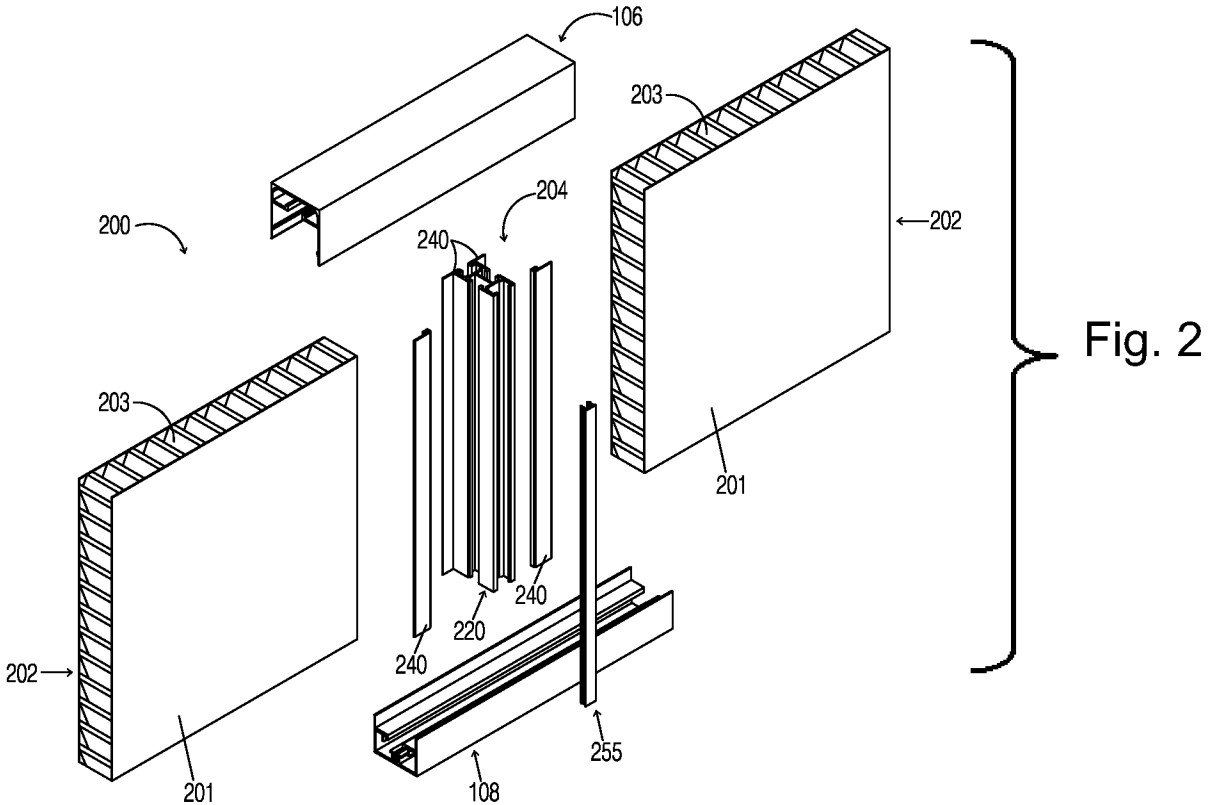
FIG. 2 is an exploded sectional perspective view of an embodiment of a screw-less batten system.

FIG. 2 is an exploded sectional perspective view of an embodiment of a screw-less batten system 200. The screw-less batten system 200 may include wall panels 202. The wall panels 202 may include a panel skin 201 and/or a panel honeycomb 203. The panel honeycomb 203 may be used to provide strength to the wall panel 202. In the present embodiment, the wall panels 202 may be 1.75 inches thick. The screw-less batten system 200 may include a floating head track 106 and/or a base track 108.

The screw-less batten system 200 includes a screw-less batten assembly 204. The screw-less batten assembly 204 may include a stud 220, removable flanges 240 and/or a closure strip 255.

Figure 3:
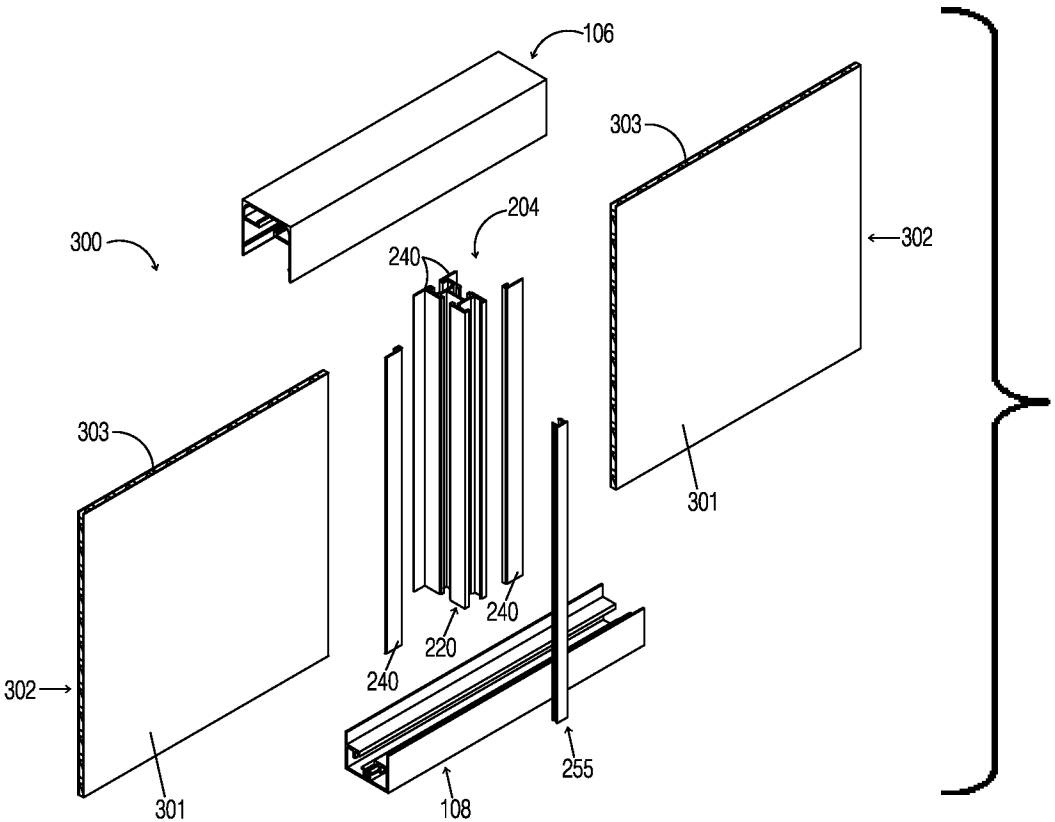
FIG. 3 is an exploded sectional perspective view of another embodiment of a screw-less batten system with thinner wall panels.

FIG. 3 is an exploded sectional perspective view of another embodiment of a screw-less batten system 300 with thinner wall panels 302. The screw-less batten system 300 may include wall panels 302. Like the previous embodiment shown in FIG. 3, the wall panels 302 may include a panel skin 301 and/or a panel honeycomb 303. The panel honeycomb 303 may be used to provide strength to the wall panel 302. However, in the present embodiment the wall panels 302 may be 0.25 inches thick. The screw-less batten system 300 may also include a floating head track 106 and/or a base track 108.

The screw-less batten system 300 includes a screw-less batten assembly 204. The screw-less batten assembly 204 may include a stud 220, removable flanges 240 and/or a closure strip 255. As shown in FIGS. 2 and 3, the screw-less batten assemblies 204 may be used with varying wall panels 202, 302.

Figure 4:
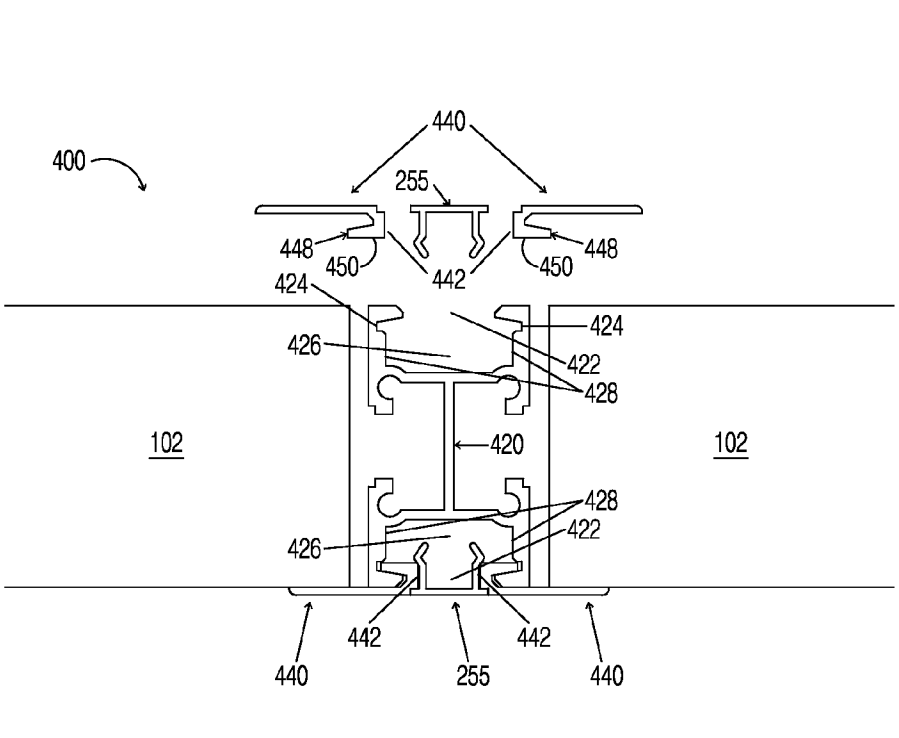
FIG. 4 is a partially exploded sectional plan view of an embodiment of a double sided screw-less batten system with four removable flanges.

FIG. 4 is a partially exploded sectional plan view of an embodiment of a double sided screw-less batten system 400 with four removable flanges 440. The batten system 400 may include a stud 420. The stud 420 may include an extruded profile. In the present embodiment, the stud 420 has two receiving troughs 424 in a neck opening 422 that may be shaped to receive the removable flanges 440. The removable flanges 440 may include a locking member 448. The locking member 448 may be inserted into the neck opening 422 and the receiving troughs 424. The removable flanges 440 may include an engaging surface 442 and/or a back support surface 450.

When the locking members 448 are inserted into the receiving trough 424, the removable flanges 440 may form the neck opening 422. A closure strip 255 may be inserted into the neck opening 422 and contact the engaging surfaces 442 of the removable flanges 440 to secure the removable flanges 440. Using the removable flanges 440 in concert with a closure strip 255 may eliminate the need for screws. Screws may no longer be necessary because the closure strip 255 may prevent the removable flanges 440 from substantial transverse motion and the removable flanges 440 may prevent substantial transverse motion of the wall panels 102. Transverse motion may be defined as motion away from the stud 420. This may be accomplished because the closure strip 255 may laterally constrain the removable flanges 440 such that the closure strip 255 may direct the locking members 448 of the removable flanges 440 into their respective receiving troughs 424, which may prevent substantial transverse motion of the removable flanges 440. In an alternative embodiment of a screw-less batten system 400, one removable flange 440 may be preassembled to reduce installation time.

The stud 420 may include a hammerhead-nut channel 426. The hammerhead-nut channel 426 may have a predetermined profile. In the present embodiment, the predetermined profile may be shaped to fit a hammerhead-nut (not shown). The hammerhead-nut channel 426 may include an internal wall 428. In the present embodiment, the stud 420 may be internally shaped more like an I-beam rather than a box. In other embodiments, the stud 420 may take various shapes.

Figure 5:
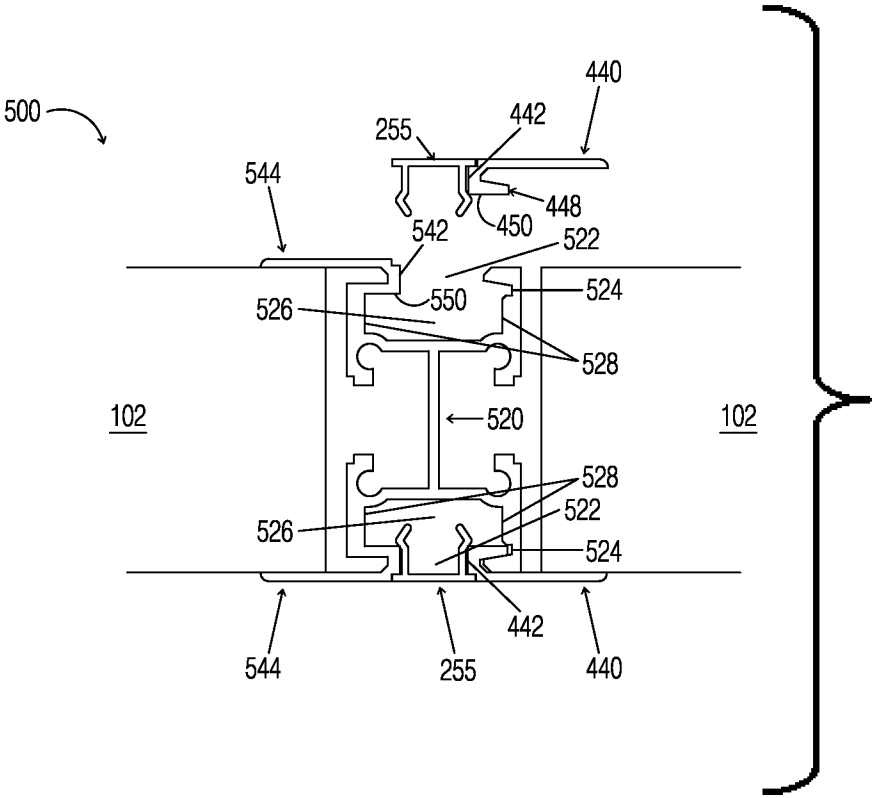
FIG. 5 is a partially exploded sectional plan view of another embodiment of a double sided screw-less batten system with integral and removable flanges.

FIG. 5 is a partially exploded sectional plan view of another embodiment of a double sided screw-less batten system 500 with integral and removable flanges 544, 440. The batten system 500 may include a stud 520. The stud 520 may include an extruded profile. The stud 520, in the present embodiment, may include an integral flange 544. The integral flange may include an engaging surface 542 and/or a back support surface 550.

In the present embodiment, the stud 520 has one receiving trough 524 in each neck opening 522 that may be shaped to receive the removable flange 440. The removable flange 440 may include a locking member 448. The locking member 448 may be inserted into the neck opening 522 and the receiving troughs 524. The removable flanges 440 may include an engaging surface 442 and/or a back support surface 450.

When a locking member 448 is inserted into the receiving trough 524, the removable flange 440 and integral flange 544 may form the neck opening 522. A closure strip 255 may be inserted into the neck opening 522 and contact the engaging surface 442 of the removable flange 440 and the engaging surface 542 of the integral flange 544 to secure the removable flange 440. Using the integral flange 544 and the removable flange 440 in concert with a closure strip 255 may eliminate the need for screws. Screws may no longer be necessary because the closure strip 255 may prevent the removable flange 440 from substantial transverse motion and the removable flange 440 and the integral flange 544 may prevent substantial transverse motion of the wall panels 102. Transverse motion may be defined as motion away from the stud 520. This may be accomplished because the closure strip 255 may laterally constrain the removable flange 440 and/or the integral flange 544 such that the closure strip 255 may direct the locking member 448 of the removable flange 440 into the receiving troughs 524, which may prevent substantial transverse motion of the removable flange 440.

The stud 520 may include a hammerhead-nut channel 526. The hammerhead-nut channel 526 may have a predetermined profile. In the present embodiment, the predetermined profile may be shaped to fit a hammerhead-nut (not shown). The hammerhead-nut channel 526 may include an internal wall 528. In an alternative embodiment, the integral flange 544 may be replaced with a removable flange 540.

The embodiments of FIGS. 4 and 5 illustrate double sided screw-less batten systems 400, 500. In other embodiments, any combination of removable flanges 440 and/or integral flanges 544 may be used to create double sided, single sided, and/or other batten systems.

Figure 6:
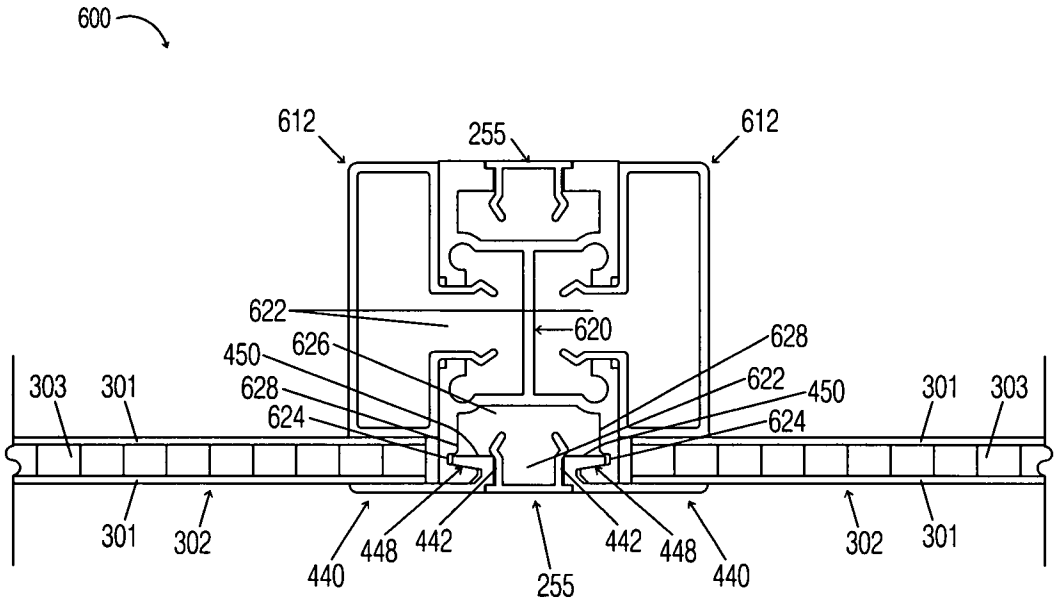
FIG. 6 is a sectional plan view of an embodiment of a single sided screw-less batten system with thinner wall panels.

FIG. 6 is a sectional plan view of an embodiment of a single sided screw-less batten system 600 with thinner wall panels 302. The batten system 600 may include a stud 620. The stud 620 may include an extruded profile. The stud 620 may be shaped to receive panel stops 612. The panel stops 612 may abut the panel skin 301 such that the wall panel 302 may be secured by the panel stop 612 and the removable flanges 440. The panel stops 612 may be shaped to fit into neck openings 622. In the present embodiment, the neck openings 622 may be formed by the stud 620 and/or the removable flanges 440. In other embodiments, the neck openings may be formed by the stud 620, the removable flanges 440 and/or the integral flanges 544.

In the present embodiment, the stud 620 has two receiving troughs 624 in a neck opening 622 that may be shaped to receive two removable flanges 440. The removable flanges 440 may include a locking member 448. The locking members 448 may be inserted into the neck opening 622 and the receiving troughs 624. The removable flanges 440 may include an engaging surface 442 and/or a back support surface 450.

When the locking members 448 are inserted into the receiving trough 624, the removable flanges 440 may form the neck opening 622. A closure strip 255 may be inserted into the neck opening 622 and contact the engaging surfaces 442 of the removable flanges 440 to secure the removable flanges 440 in place. Using the removable flanges 440 in concert with a closure strip 255 may eliminate the need for screws. Screws may no longer be necessary because the closure strip 255 may prevent the removable flanges 440 from substantial transverse motion and the removable flanges 440 may prevent substantial transverse motion of the wall panels 302. This may be accomplished because the closure strip 255 may laterally constrain the removable flanges 440 such that the closure strip 255 may direct the locking members 448 of the removable flanges 440 into their respective receiving troughs 624, which may prevent substantial transverse motion of the removable flanges 440.

The stud 620 may include a hammerhead-nut channel 626. The hammerhead-nut channel 626 may have a predetermined profile. In the present embodiment, the predetermined profile may be shaped to fit a hammerhead-nut (not shown). The hammerhead-nut channel 626 may include an internal wall 628.

Figure 7:
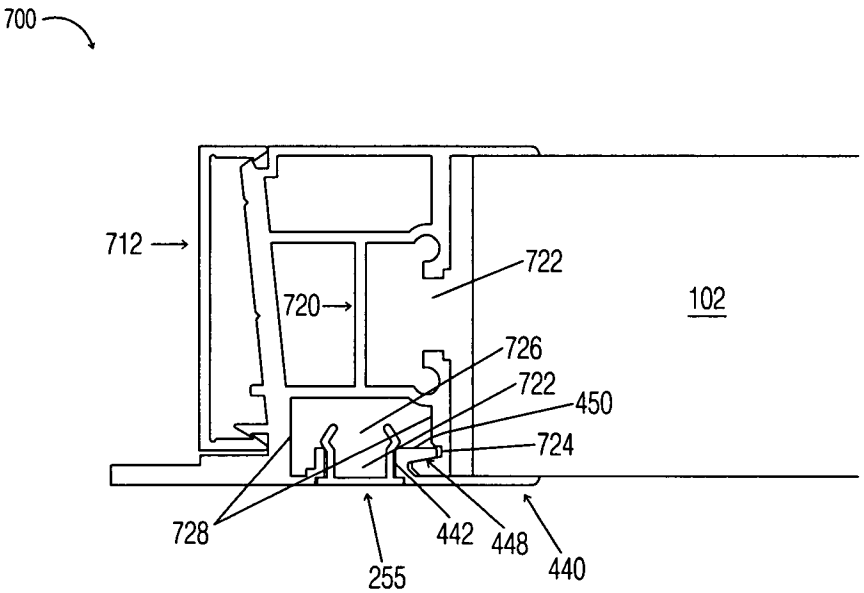
FIG. 7 is a sectional plan view of another embodiment of a single sided screw-less batten system that may be used as a door opening.

FIG. 7 is a sectional plan view of another embodiment of a single sided screw-less batten system 700 that may be used as a door opening. The batten system 700 may include a stud 720. The stud 720 may include an extruded profile. The stud 720, in the present embodiment, may be shaped to receive a panel stop 712. The panel stop 712 may connect to the stud 720 and may provide a finished look to the door opening.

In the present embodiment, the stud 720 has one receiving trough 724 in the neck opening 722 that may be shaped to receive a removable flange 440. The removable flange 440 may include a locking member 448. The locking member 448 may be inserted into the neck opening 722 and the receiving trough 724. The removable flange 440 may include an engaging surface 442 and/or a back support surface 450.

When a locking member 448 is inserted into the receiving trough 724, the removable flange 440 and stud 720 may form the neck opening 722. A closure strip 255 may be inserted into the neck opening 722 and contact the engaging surface 442 of the removable flange 440 and the stud 720 to secure the removable flange 440. Using the stud 720 and the removable flange 440 in concert with a closure strip 255 may eliminate the need for screws. Screws may no longer be necessary because the closure strip 255 may prevent the removable flange 440 from substantial transverse motion and the removable flange 440 may prevent substantial transverse motion of the wall panel 102. Transverse motion may be defined as motion away from the stud 720. This may be accomplished because the closure strip 255 may laterally constrain the removable flange 440 such that the closure strip 255 may direct the locking member 448 of the removable flange 440 into the receiving trough 724, which may prevent substantial transverse motion of the removable flange 440.

The stud 720 may include a hammerhead-nut channel 726. The hammerhead-nut channel 726 may have a predetermined profile. In the present embodiment, the predetermined profile may be shaped to fit a hammerhead-nut (not shown). The hammerhead-nut channel 726 may include internal walls 728.

Figure 10:
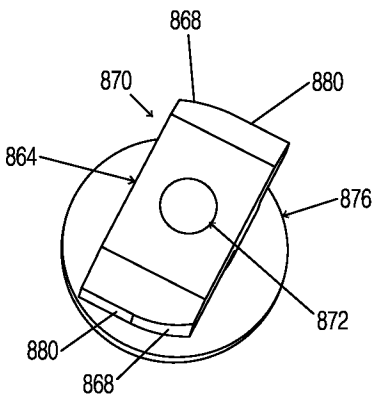
FIG. 10 is a bottom view of the assembled embodiment of a hammerhead-nut system as shown in FIG. 8.
Figure 9:
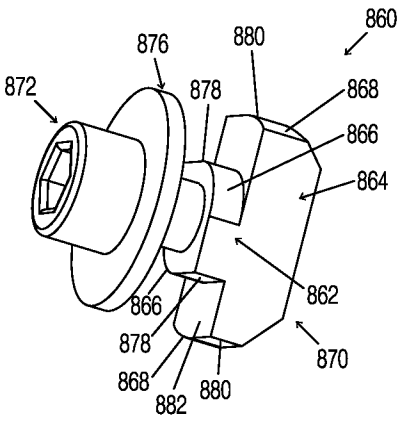
FIG. 9 is an isometric view of the assembled embodiment of a hammerhead-nut system as shown in FIG. 8.
Figure 8:
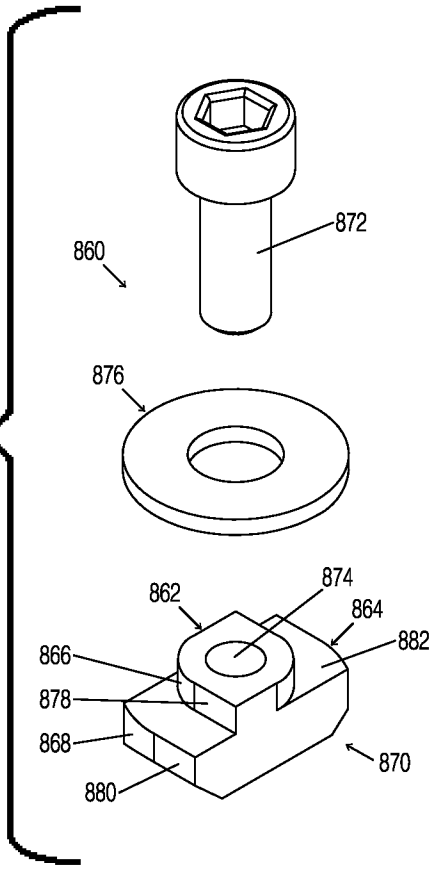
FIG. 8 is an exploded isometric view of an embodiment of a hammerhead-nut system.

Referring to FIGS. 8, 9 and 10, FIG. 8 is an exploded isometric view of an embodiment of a hammerhead-nut assembly 860, FIG. 9 is an isometric view of the assembled system 860 and FIG. 10 is a bottom view of the assembled system 860. The hammerhead-nut assembly 860 includes a hammerhead-nut 870, a hammerhead-nut screw 872 and a hammerhead-nut washer 876. In the present embodiment, the hammerhead-nut screw 872 is a cap head screw. In alternative embodiments, the hammerhead-nut screw 872 may be any fastener that may fasten to the hammerhead-nut 870 and support an attachment (not shown). The hammerhead-nut 870 may include threads 874 to receive the hammerhead-nut screw 872. The hammerhead-nut 870 may also include a flange engaging portion 862 and a stud engaging portion 864.

The flange engaging portion 862 may include a chamfer 866 to facilitate the rotation of the hammerhead-nut system 860 to engage an integral and/or removable flange (not shown). A flange engaging surface 878 on the flange engaging portion 862 of the hammerhead-nut 870 may be used to engage an engaging surface (not shown) of an integral flange (not shown) a removable flange (not shown).

The stud engaging portion 864 may also include a chamfer 868 to facilitate rotation of the hammerhead-nut system 860 to engage a hammerhead-nut channel (not shown). A stud engaging surface 880 on the stud engaging portion 864 of the hammerhead-nut 870 may also be used to engage an internal wall (not shown) of the hammerhead-nut channel. The hammerhead-nut 870 may also include a back support surface 882.

When assembled, the hammerhead-nut screw 872 is inserted through the hammerhead-nut washer 876 and engages the threads 874 on the hammerhead-nut 870. When used with a shelf or other attachment, the hammerhead-nut screw 872 may be inserted through a portion of the shelf such that portion of the shelf is pressed between the outside surface of the batten system (not shown) and the hammerhead-nut washer 876. Additional hammerhead-nut washers 876 may also be used as needed.

Typically, a chamfer 866 on the flange engaging portion 862 and a chamfer 868 on the stud engaging portion 864 of the hammerhead-nut 870 may be found on the same corners of the hammerhead-nut 870. In the present embodiment, the two chamfers 868 on the stud engaging portion 864 may be located at opposite corners from each other and the two chamfers 866 on the flange engaging portion 862 may also be located at opposite corners from each other. An assembled hammerhead-nut system 860 may be used with a screw-less batten system as will be discussed below.

The hammerhead-nut system 860 may be placed anywhere along the length of the batten system (not shown) and may be removed by reversing the hammerhead-nut screw 872. A closure strip (not shown) may be interrupted wherever a hammerhead-nut is attached to the batten system 104.

Figure 11:
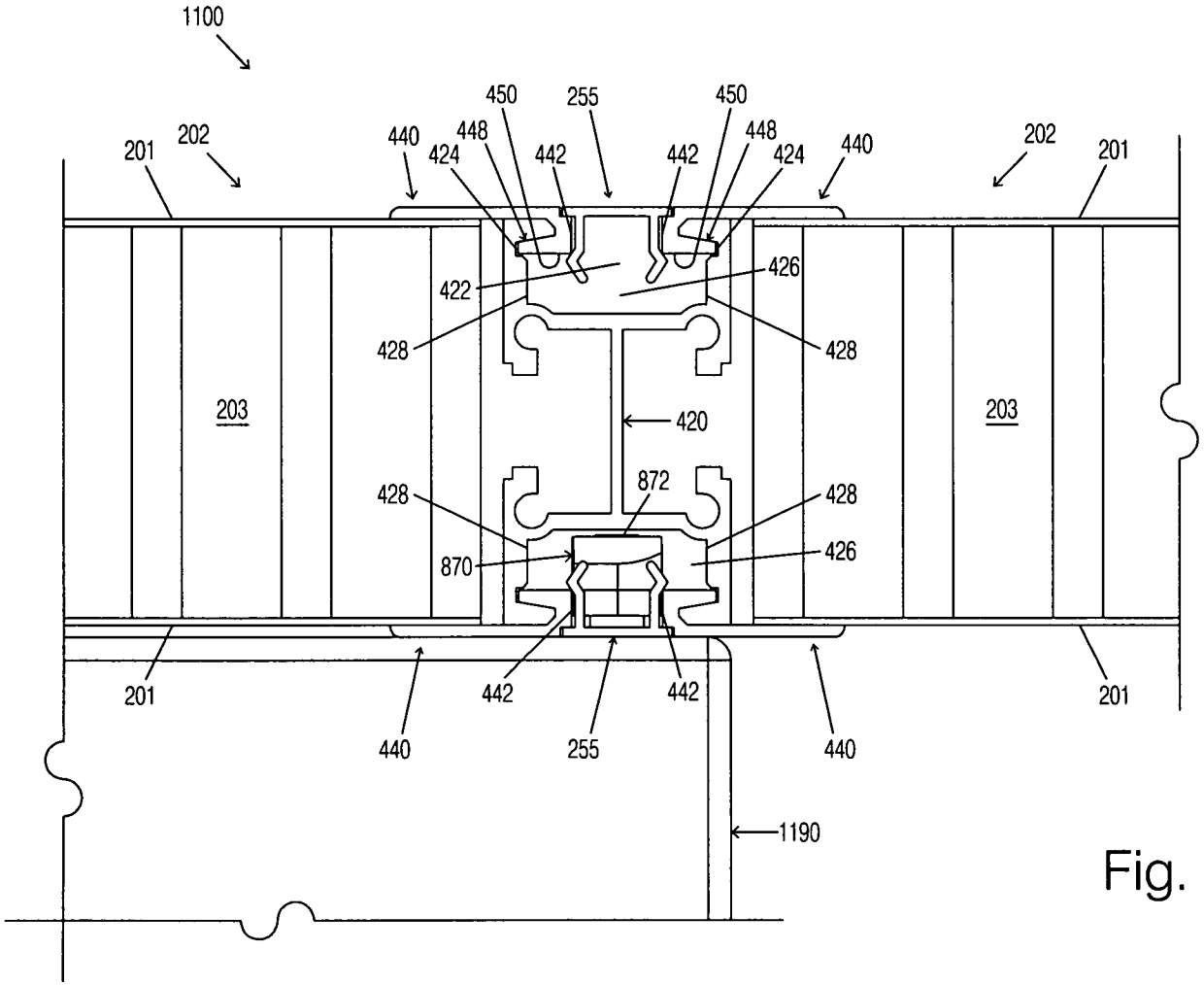
FIG. 11 is an assembled sectional plan view of the embodiment of a screw-less batten system for a double-sided wall shown in FIG. 4, showing a hammerhead-nut in its insertion orientation and an attachment.
Figure 12:
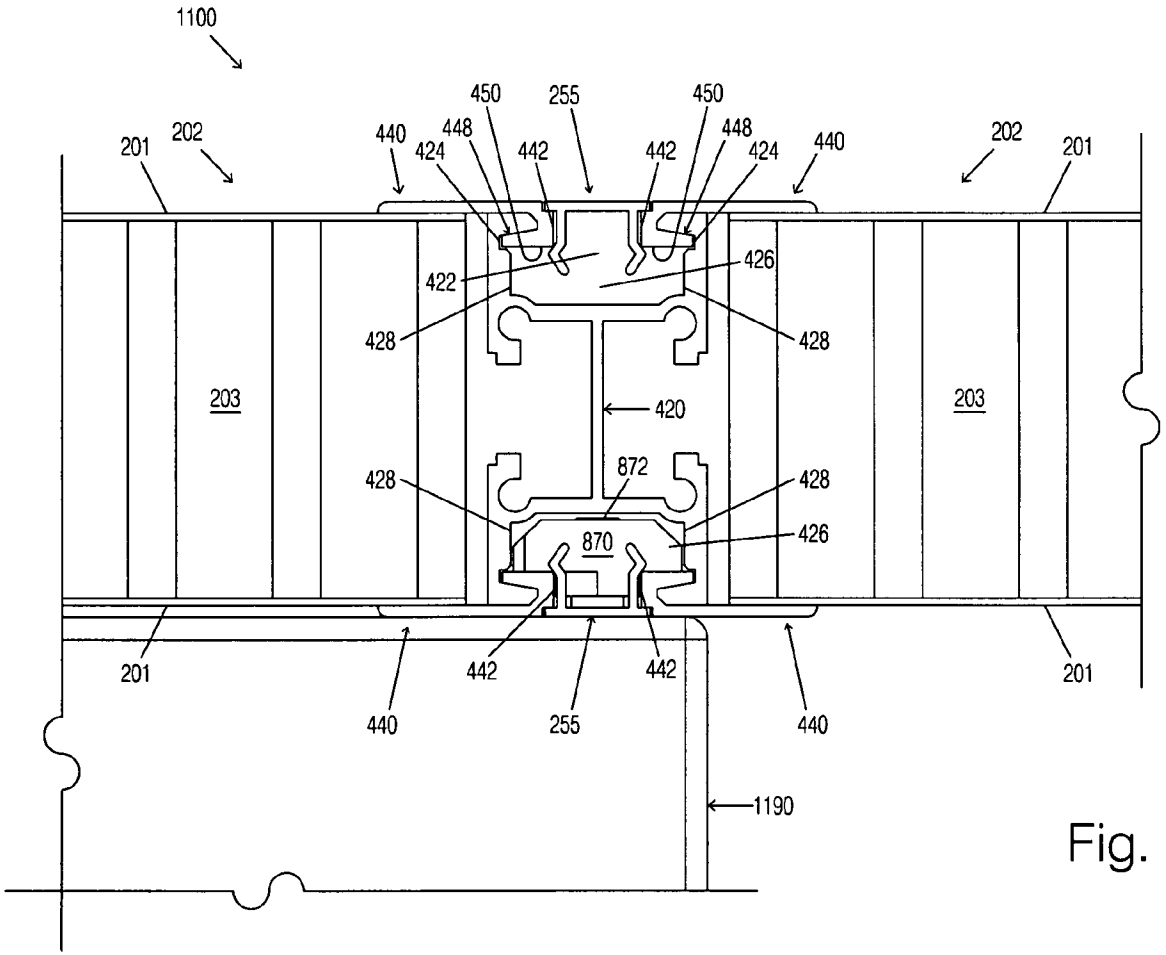
FIG. 12 is an assembled sectional plan view of the embodiment of a screw-less batten system for a double-sided wall shown in FIG. 4, showing a hammerhead-nut in its secured orientation and an attachment.
Figure 13:
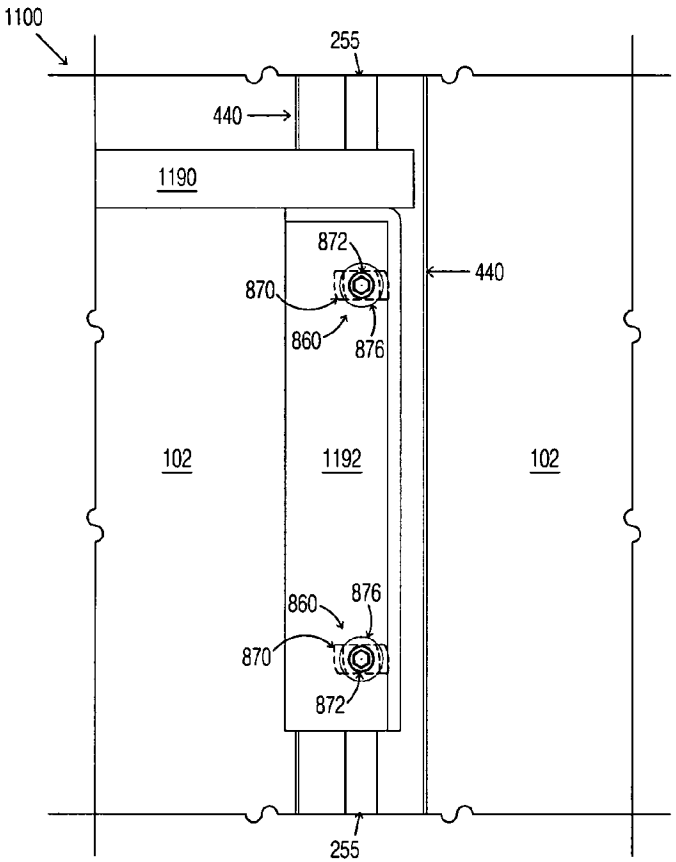
FIG. 13 is a cutaway elevation view of the embodiment of a screw-less batten system for a double-sided wall shown in FIG. 4, a hammerhead-nut and attachment.

Referring to FIGS. 11, 12 and 13, FIG. 11 is a sectional plan view of the embodiment of a screw-less batten system 1100 for a double-sided wall with a hammerhead-nut channel 426, a hammerhead-nut 870 in its insertion orientation and an attachment; FIG. 12 is a sectional plan view of the assembled system 1100 as shown in FIG. 11 with the hammerhead-nut 870 in its secured orientation; and FIG. 13 is a cutaway elevation view of the assembled system 1100 as shown in FIG. 4. On one side of the system 1100, the closure strip 255 may be uncut and therefore may run the length of the neck opening 422. On the other side of the system 1100, the closure strip 255 may be cut into several pieces and installed, as discussed above.

The attachment, in the present embodiment, may be a shelf 1190. Other attachments may be used. For example, attachments may include fire extinguishers, process piping, monitor shelves, keyboard shelves, utility shelves, structural bracing, schedule boards, wafer transport tracks, mini-environments, temporary partitioning, electrical conduit and outlets, communication conduits and outlets, signage, work stations and/or other attachments.

As shown in FIG. 13, the shelf 1190 may include a bracket 1192 that is secured by two hammerhead-nut assemblies 860. In the present embodiment, the shelf 1190 may rest on the bracket 1192. In other embodiments, the shelf 1190 may be attached to and/or integrated with the bracket 1192. The brackets 1192 may have pre-drilled holes (not shown) through which the hammerhead-nut screw 872 may be inserted. The hammerhead-nut screw 872 may also be inserted through the hammerhead-nut washer 876, as discussed above. The hammerhead-nut screw 872 may be inserted through the pre-drilled bracket holes. The hammerhead-nut screw 872 may be inserted through the brackets 1192 such that the washer 876 abuts the brackets 1192 on one side and the batten assembly 1100 abuts the brackets 1192 on the other side. Then the hammerhead-nut screw 872 may be fastened to the hammerhead-nut 870.

In the present embodiment, the hammerhead-nut screw 872 is fastened to the hammerhead-nut 870 by the hammerhead-nut threads 874. The shelf 1190 may be pressed against the removable flanges 440 by the hammerhead-nut screw 872 and washer 876. The hammerhead-nut screw 872 is also shown to nearly touch the bottom of the hammerhead-nut channel 426. In an alternative embodiment, the hammerhead-nut screw 872 may be shorter to prevent potential contact between the hammerhead-nut screw 872 and the hammerhead-nut channel 426. A further alternative embodiment may use the hammerhead-nut screw 872 as an additional contact point with the hammerhead-nut channel 426 to hold the hammerhead-nut 870 in place.

The removable flanges 440 and closure strips 255 may be inserted into the neck opening 422 before the hammerhead-nut 870 is inserted into the hammerhead-nut channel 426. In the present embodiment, two closure strips 255 are inserted into the neck opening 422, as shown in FIG. 13, i.e. one above the top hammerhead-nut assembly 860 and one below the bottom hammerhead-nut assembly 860. A third closure strip 255 may be inserted between the two hammerhead-nut assemblies 860. In other embodiments, only one closure strip 255 may be used.

The hammerhead-nut screw 872 may be rotated such that the hammerhead-nut 870 can slide between the engaging surfaces 442 of the removable flanges 440. The hammerhead-nut 870 may then be inserted through the neck opening 422 and into the hammerhead-nut channel 426. The hammerhead-nut screw 872 may then be rotated such that the flange engaging portion chamfers 866 begin to contact the engaging surfaces 442 of the removable flanges 440 while the stud engaging portion chamfers 868 begin to contact the hammerhead-nut channel internal wall 428.

The hammerhead-nut screw 872 may continue to be turned until the flange engaging surface 878 is substantially coplanar with the engaging surfaces 442 of the removable flanges 440 and/or the hammerhead-nut channel engaging surface 880 is substantially coplanar with the hammerhead-nut channel internal wall 428. At this point, the hammerhead-nut 870 may be seated in the hammerhead-nut channel 426 such that the flange engaging surface 878 may press transversely against the engaging surfaces 442 of the removable flanges 440 and the hammerhead-nut channel engaging surface 880 may press transversely against the hammerhead-nut channel internal wall 428. These transverse forces may hold the hammerhead-nut 870 in place such that the shelf 1190 or any other attachment may support a load. As seen in FIG. 12, the back support surface 882 of the hammerhead-nut 870 may abut the back support surfaces 450 of removable flanges 440. This may aid in preventing the hammerhead-nut 870 from moving away from the removable flanges 440. FIG. 12 also shows how the flange engaging surface 878 may engage the engaging surface 442 of the removable flange 440. Having more than one engaging surface 878, 880 may also aid in preventing the hammerhead-nut 870 from moving within the stud 420.

In the present embodiment, the hammerhead-nut threads 874 are threaded normally. In an alternative embodiment, the hammerhead-nut threads 874 may be reverse threaded. The direction of the threads 874 typically should match the chamfers 866, 868, such that when the hammerhead-nut screw 872 is tightened, the force may be translated from the hammerhead-nut screw 872 to the hammerhead-nut threads 874 and thereby causing the hammerhead-nut 870 to rotate in the direction of the applied force such that the hammerhead-nut 870 engages the hammerhead-nut channel 426 and/or the engaging surfaces 442 (or 542 in the case of an integral flange 544).

Likewise, when the hammerhead-nut screw 872 begins to be removed, the rotational forces may be transmitted to the hammerhead-nut threads 874 and thereby the hammerhead-nut 870, causing the hammerhead-nut 870 to rotate and disengage the hammerhead-nut channel 426 and/or the engaging surfaces 442. The present embodiment may require a one-quarter turn of the hammerhead-nut screw 872 to engage and disengage the hammerhead-nut 870.

It should be noted that the hammerhead-nut may not even require the flanges 440, 544 be attached to the stud 420, 520, 620, 720. Furthermore, aspects of the present embodiment and other embodiments may be combined to achieve some of the advantages of a screw-less batten system. For example, a hammerhead-nut channel 426, 526, 626, 726 may be used in connection with the single sided wall screw-less batten system 600, as shown in FIG. 6. The stud 620 may be modified such that a hammerhead-nut channel 426, 526 may be used with the stud 620.

While specific embodiments and applications of the present invention have been illustrated and described, it is to be understood that the invention is not limited to the precise configuration and components disclosed herein. Various modifications, changes and variations which will be apparent to those skilled in the art may be made in the arrangement, operation, and details of the methods and systems of the present invention disclosed herein without departing from the spirit and scope of the invention.

The invention claimed is:

1. A screw-less batten system to which attachments may be secured comprising:

a stud having a predetermined extruded profile comprising:

at least one receiving trough in the predetermined extruded profile, the predetermined extruded profile of the at least one receiving trough has a hammerhead-nut channel having a predetermined profile shaped to receive a hammerhead-nut of a hammerhead-nut assembly, the hammerhead-nut assembly comprising a hammerhead-nut screw to which attachments are secured and the hammerhead-nut; and a neck opening in the at least one receiving trough, the neck opening having a width that is less than the width of the hammerhead-nut channel; and a batten assembly for connection to the stud without using a screw, comprising:

at least one removable flange engaging the stud at the neck opening of one of the at least one receiving trough; and at least one closure strip engaging one of the at least one removable flange to secure the flange within the receiving trough without using a screw, at least one of the at least one removable flange and the at least one closure strip defining an outside surface for the batten assembly, the hammerhead-nut screw inserted through the attachment such that a portion of the attachment is pressed between the outside surface of the batten assembly and the hammerhead-nut screw.

2. The screw-less batten system of claim 1, wherein the hammerhead-nut is inserted between two of the closure strips.

3. The screw-less batten system of claim 1, wherein the hammerhead-nut channel further comprises an internal wall and wherein the hammerhead-nut of the hammerhead-nut assembly is oriented for insertion through the neck opening and into the hammerhead-nut channel in the stud.

4. The screw-less batten system of claim 3, wherein the hammerhead-nut is movable within the hammerhead-nut channel from its orientation for insertion to an orientation wherein the hammerhead-nut secures the hammerhead-nut assembly to the stud and the at least one removable flange further comprises an engaging surface and the hammerhead-nut further comprises a flange engaging surface, the flange engaging surface of the hammerhead-nut engages the engaging surface of the at least one flange when the hammerhead-nut is oriented to secure the hammerhead-nut assembly to the stud.

5. The screw-less batten system of claim 3, wherein the hammerhead-nut further comprises a stud engaging surface, and wherein the stud engaging surface of the hammerhead-nut engages the internal wall of the hammerhead-nut channel.

6. The screw-less batten system of claim 3, wherein the at least one removable flange further comprises a back support surface and the hammerhead-nut further comprises a back support surface, at least a portion of the back support surface of the hammerhead-nut abuts at least a portion of the back support surface of the at least one removable flange.

7. The screw-less batten system of claim 3, wherein the hammerhead-nut is movable within the hammerhead-nut channel from its orientation for insertion to an orientation wherein the hammerhead-nut engages the internal wall and secures the hammerhead-nut assembly to the stud.

8. The screw-less batten system of claim 1, wherein the at least one removable flange further comprises a locking member and an engaging surface and wherein the at least one closure strip secures the engaging surface of the at least one removable flange such that the locking member of the removable flange is inserted into the corresponding at least one receiving trough.

9. The screw-less batten system of claim 8, wherein the at least one receiving trough prevents substantial transverse motion of the corresponding at least one removable flange.

10. The screw-less batten system of claim 1, wherein the stud further comprises an integral flange.

11. The screw-less batten system of claim 1, further comprising a wall panel.

12. The screw-less batten system of claim 11, wherein the at least one removable flange prevents substantial transverse motion of the wall panel.

13. The screw-less batten system of claim 1, further comprising an attachment member, wherein the attachment member is supported by the hammerhead-nut assembly when it is secured to the stud.

14. The screw-less batten system of claim 13, wherein the hammerhead-nut prevents substantial transverse motion of the attachment member.

15. The screw-less batten system of claim 13, wherein the hammerhead-nut prevents substantial vertical motion of the attachment member.

16. The screw-less batten system of claim 1, wherein the stud further comprises:

a second neck opening with at least one receiving trough; and a second hammerhead-nut channel having a predetermined profile shaped to receive a hammerhead-nut of the hammerhead-nut assembly.

17. A wall system with a screw-less batten assembly for use in a cleanroom comprising:

a plurality of wall panels;

a plurality of removable flanges, each removable flange comprising:

an engaging surface; and a locking member;

at least one stud having a predetermined extruded profile for disposition between adjacent pairs of the wall panels comprising:

at least one receiving trough in the predetermined extruded profile wherein each receiving trough is shaped to receive the locking member of one of the removable flanges;

a hammerhead-nut channel having a predetermined profile, the hammerhead-nut channel comprising an internal wall; and a neck opening in the at least one receiving trough, the neck opening having a width that is less than the width of the hammerhead-nut channel;

a plurality of closure strips each disposable within the neck opening to secure the engaging surface of one of the removable flanges such that the locking member of the removable flange is inserted into one of the at least one receiving trough to prevent substantial transverse motion of the removable flange;

a hammerhead-nut assembly comprising a hammerhead-nut screw and a hammerhead-nut, the hammerhead-nut screw with the hammerhead-nut connected is inserted through the neck opening and into the hammerhead-nut channel in the stud between an adjacent pair of the closure strips, the hammerhead-nut being movable from an insertion orientation to a secured orientation, the hammerhead-nut comprising:

a flange engaging surface that engages the engaging surface of at least one of the removable flanges when the hammerhead-nut is in the secured orientation; and a stud engaging surface that engages the internal wall of the hammerhead-nut channel when the hammerhead-nut is in the secured orientation; and an attachment that is supported by the hammerhead-nut assembly when the hammerhead-nut screw is inserted through the attachment and the hammerhead-nut is in the secured orientation such that the hammerhead-nut prevents substantial transverse motion of the attachment.

18. The wall system of claim 17, wherein the stud further comprises:

a second neck opening with at least one receiving trough for receiving the locking member of one of the removable flanges; and a second hammerhead-nut channel having a predetermined profile shaped to receive the hammerhead-nut of the hammerhead-nut assembly.

19. A screw-less batten system for cleanroom walls comprising:

at least one wall panel;

a removable flange comprising:

an engaging surface;

a back support surface; and a locking member;

a stud comprising:

a neck opening with a receiving trough that prevents substantial transverse motion of the removable flange;

an integral flange comprising an engaging surface and a back support surface; and a jamb-nut channel having a predetermined profile, the jamb-nut channel comprising an internal wall;

a plurality of closure strips that secure the engaging surface of the removable flange and the engaging surface of the integral flange such that the locking member of the removable flange is inserted into the receiving trough and wherein the removable flange and the integral flange prevent substantial transverse motion of the wall panel;

a jamb-nut inserted through the neck opening and into the jamb-nut channel in the stud between two closure strips, the jamb-nut comprising:

a flange engaging surface that engages the engaging surface of the removable flange and the engaging surface of the internal flange;

a stud engaging surface that engages the internal wall of the jamb-nut channel; and a back support surface, wherein at least a portion of the back support surface of the jamb-nut abuts at least a portion of the back support surface of the removable flange and the integral flange; and an attachment that is connected to the jamb-nut such that the jamb-nut prevents substantial transverse motion of the attachment.

20. The screw-less batten system of claim 19, wherein the stud further comprises:

a second neck opening with a receiving trough;

a second integral flange comprising an engaging surface and a back support surface; and a second jamb-nut channel having a predetermined profile.

* * * * *